US008182886B2

(12) United States Patent
Pfeiffer et al.

(10) Patent No.: US 8,182,886 B2
(45) Date of Patent: May 22, 2012

(54) COMPOSITE ARTIFICIAL GRASS AND METHOD FOR MANUFACTURING SAME

(75) Inventors: Frank Pfeiffer, Rijssen (NL); Marinus Hendrikus Olde Weghuis, Oldenzaal (NL); Frederik Jan Van Der Gaag, Nijverdal (NL); Hermannus Hendrik Jager, Wierden (NL)

(73) Assignee: Ten Cate Thiolon, B.V. (NL)

( * ) Notice: Subject to any disclaimer, the term of this patent is extended or adjusted under 35 U.S.C. 154(b) by 318 days.

(21) Appl. No.: 12/312,520

(22) PCT Filed: Nov. 13, 2007

(86) PCT No.: PCT/NL2007/000283
§ 371 (c)(1),
(2), (4) Date: Jun. 11, 2009

(87) PCT Pub. No.: WO2008/060143

PCT Pub. Date: May 22, 2008

(65) Prior Publication Data

US 2010/0047487 A1 Feb. 25, 2010

(30) Foreign Application Priority Data

Nov. 16, 2006 (NL) ..... 1032876

(51) Int. Cl.
*A01N 3/00* (2006.01)
*A01B 79/00* (2006.01)

(52) U.S. Cl. ..... 428/17; 428/23; 47/58.1 R

(58) Field of Classification Search ..... 428/17, 428/23; 47/58.1, 58.1 R
See application file for complete search history.

(56) References Cited

U.S. PATENT DOCUMENTS 4,389,434 A * 6/1983 Polman ..... 428/17
4,396,653 A * 8/1983 Tomarin ..... 428/17
4,617,208 A 10/1986 Cadenhead, Sr.
(Continued)

FOREIGN PATENT DOCUMENTS

EP 0 432 439 A2 11/1990
EP 1 411 160 A1 4/2004
EP 1 580 307 A1 9/2005
EP 1 705 292 A1 9/2006

OTHER PUBLICATIONS http://nyp-corp.com/.*

*Primary Examiner* — Cathy Lam
(74) *Attorney, Agent, or Firm* — Olson & Cepuritis, Ltd.

(57) ABSTRACT

The invention relates to a composite artificial grass fiber for use in an artificial lawn, in particular an artificial grass sports field, which artificial grass fiber is made up at least of several monofilament fibers. The invention further relates to an artificial lawn, in particular an artificial grass sports field built up of a substrate to which composite artificial grass fibers according to the invention are attached. The invention also relates to a method for manufacturing a composite artificial grass fiber according to the invention, in particular for an artificial lawn, which comprises the steps of manufacturing several monofilament fibers and forming said several monofilament fibers into a composite artificial grass fiber. The object of the invention is to provide a composite artificial grass fiber as well as an artificial grass sports field comprising such an artificial grass fiber, which makes it possible to apply and distribute infill material between the composite fibers in a simpler manner without the eventual playing characteristics of the artificial grass sports field being adversely affected. According to the invention, the artificial grass fiber is to that end characterized in that the artificial grass fiber further comprises an additive made of a decomposable material, which holds said several monofilament fibers together temporarily.

15 Claims, 3 Drawing Sheets

U.S. PATENT DOCUMENTS

| | | | | | |
|---|---|---|---|---|---|
| 4,628,848 | A | | 12/1986 | Culgan et al. | |
| 4,705,706 | A | * | 11/1987 | Avery | 428/17 |
| 4,735,825 | A | * | 4/1988 | Friedrich | 427/202 |
| 5,489,317 | A | * | 2/1996 | Bergevin | 47/1.01 R |
| 5,850,708 | A | * | 12/1998 | Bergevin | 47/1.01 R |
| 6,029,397 | A | * | 2/2000 | Motz et al. | 47/58.1 R |
| 6,035,577 | A | * | 3/2000 | Motz et al. | 47/58.1 R |
| 6,173,528 | B1 | * | 1/2001 | Motz et al. | 47/58.1 R |
| 6,295,756 | B1 | * | 10/2001 | Bergevin | 47/1.01 R |
| 7,939,144 | B2 | * | 5/2011 | Verleyen | 428/17 |

* cited by examiner

COMPOSITE ARTIFICIAL GRASS AND METHOD FOR MANUFACTURING SAME

This application is the U.S. National Stage of International Application No. PCT/NL2007/000283 filed Nov. 13, 2007, the entire disclosures of which are incorporated herein by reference.

The invention relates to a composite artificial grass fibre for use in an artificial lawn, in particular an artificial grass sports field, which artificial grass fibre is made up at least of several artificial grass fibres.

The invention further relates to an artificial lawn, in particular an artificial grass sports field built up of a substrate to which composite artificial grass fibres according to the invention are attached.

The invention also relates to a method for manufacturing a composite artificial grass fibre according to the invention, in particular for an artificial lawn, which comprises the steps of manufacturing several artificial grass fibres (for example: tapes, bands or monofilaments) and forming said several artificial grass fibres into a composite artificial grass fibre.

Several sports, such as field hockey, tennis, American football etc., etc., are currently played on an artificial grass sports field, which sports field is composed of composite artificial grass fibres attached to a substrate, which are made up of several artificial grass fibres made of a synthetic material. Artificial grass sports fields require less maintenance and can be played on much more intensively than natural grass sports fields. To achieve playing characteristics that resemble those of natural grass as much as possible, a granular material, such as sand or plastic grains, is infilled between the artificial grass fibres. These infilled grains not only provide a softer, damping playing surface on which players are less prone to injury, therefore, but they also provide improved playing characteristics.

The production of a standard artificial grass fibre and the processing thereof into an artificial lawn for use in an artificial grass sports field takes place in a number of steps. Said steps can be subdivided as follows: compounding, extruding, possibly assembling and subsequently twining, tufting and coating.

The system of providing artificial grass sports field with an infill has a number of drawbacks, however. Not only is the installation of such an artificial grass sports field more labour-intensive than natural grass, but an infilled artificial grass sports field also requires maintenance after being installed. After all, the infill material is deposited on the composite artificial grass fibres upon installation of an artificial grass sports field, after which the field is subjected to a brushing operation so as to obtain a regular, homogeneous distribution of the infill between the composite artificial grass fibres. The infill material functions as a damping under-layer between the artificial grass fibres, from which layer of infill material the several artificial grass fibres project similarly to a natural lawn, in which the grass-stalks are planted in the earth.

A drawback of the present artificial grass sports field is that when the infill material is applied to the artificial grass sports field, said infill material is initially deposited on top of the lawn, so that the artificial grass fibres are covered with the layer of infill material. In this way an artificial grass sports field is obtained in which the artificial grass fibres are inadequately distributed. The more densely the artificial grass fibres are provided in the artificial lawn, the more intensively the field needs to be brushed in order to distribute the infill material homogeneously between the fibres yet. An intensive brushing operation may lead to the artificial grass fibre being mechanically overloaded, however, resulting in premature damage to the fibre.

The above problem can be solved in part by having the composite artificial grass fibre, which is made up of several sub-fibres, wrapped in auxiliary fibre(s), as suggested in US patent publication No. 2006/159917. Tufting a wrapped artificial grass fibre thus composed may present problems, however, because the auxiliary fibre(s) is (are) not under tension and consequently may easily accumulate in front of the eye of the tufting needle. This leads to yarn breakage and thus to faults and/or delays in the tufting process. In addition to that, as indicated in US 2006/159917, in order to obtain an artificial lawn having a sufficiently open fibre surface, such a composite artificial grass fibre, needs to be subjected to a brushing operation for removing the auxiliary fibre wrapped around the sub-fibres and obtain separate sub-fibres in the lawn. A brushing operation is time-consuming and labourious, however, whilst in addition it may cause damage to the artificial grass fibres.

Another drawback is the current, complex manufacturing process of a composite artificial grass fibre, viz. joining together individual fibres and subsequently twining said joined-together fibres to obtain a composite artificial grass fibre.

Furthermore, malfunctions frequently occur when attaching (by tufting) such known composite artificial grass fibres to the (artificial) lawn because in some cases not all the individual fibres pass through the eye of the tufting needle but obstruct/block the passage. In some cases undesirable "loop piles" are present in the final artificial lawn in addition to "cut piles", because not all the individual fibres are picked up by the "loopers" of the tufting machine, as a result of which not all the individual fibres are cut into "cut piles".

The object of the invention is therefore to provide a composite artificial grass fibre as well as an artificial grass sports field comprising such a composite artificial grass fibre, which, in addition to making it possible to realise a simpler production process of composite artificial grass fibres and a simpler incorporation of such artificial grass fibres in an artificial lawn, also makes it possible to distribute the infill material between the composite fibres in an efficient manner without the eventual playing characteristics of the artificial grass sports field being adversely affected.

According to the invention, the composite artificial grass fibre is to that end characterised in that the artificial grass fibre further comprises an additive made of a decomposable material, which holds said one or more individual artificial grass fibres together temporarily. In this way the production of the composite artificial grass fibre and the artificial lawn and the brushing-in of the infill material upon installing the artificial grass sports field can be made significantly easier, because each of the composite artificial grass fibres can be regarded more or less as one fibre made up of held-together artificial grass fibres. The production process can be simplified, and thus the risk of the artificial grass fibres being overloaded and being covered with the infill material is eliminated or reduced.

Depending on the use for which the composite artificial grass fibre according to the invention is produced, the additive that holds the artificial grass fibres together temporarily will lose its holding function during the production process or after the artificial grass sports field has been installed and the infill material has been brushed in on account of its decomposable nature and thus provide an artificial grass fibre field consisting of separate artificial grass fibres.

The manufacturing process of an artificial grass fibre composed of several individual fibres is furthermore significantly simplified in that the twining step is simply replaced by an enveloping step after the joining step, in which enveloping step the additive a decomposable material, which holds said one or more artificial grass fibres together temporarily, is provided round the several fibres.

Furthermore, a composite artificial grass fibre provided with an additive made of a decomposable material, which holds said one or more artificial grass fibres together temporarily, can be handled more efficiently during the tufting process, because a composite artificial grass fibre according to the invention can be passed through the eye of a tufting needle more easily and with a reduced risk of spoilage/blockage during the tufting process.

In one embodiment the additive is provided round the several artificial grass fibres, being configured as a foil envelope. In a special version of the latter embodiment, the additive is configured as a tubular envelope.

In another functional embodiment of an artificial grass fibre according to the invention, the additive is provided round and between said one or more artificial grass fibres. More functionally, said additive is configured as a substance that adheres to the artificial grass fibres in that case. Said substance may for example hold the various artificial grass fibres together in such a manner that the artificial grass fibres can be regarded as one fibre.

Furthermore, the additive that holds said one or more artificial grass fibres together temporarily may be biodegradable, which reduces the burden on the environment. In a functional embodiment thereof, the additive that holds the several artificial grass fibres together temporarily may be degradable under the influence of light, for example ultraviolet light.

On the other hand, the additive that holds said one or more artificial grass fibres together temporarily may be degradable under the influence of a reagent. In this way the additive can be made to decompose after the artificial grass sports field has been installed and the infill material has been brushed in by adding a reagent so as to obtain separate, individual artificial grass fibres (similar to a natural lawn). Said reagent may be spread or sprayed over the artificial grass sports field, for example.

In one embodiment, the additive that holds said one or more artificial grass fibres together temporarily may furthermore be soluble, for example in water. This is a more functional solution, since the decomposition of the additional additive can also take place under the influence of rain water in this case.

In one embodiment, the additive that holds said one or more artificial grass fibres together temporarily can furthermore be removed by means of a thermal (for example during coating) and/or mechanical treatment during or after the production process.

According to another possibility, a combination of the above possibilities of removing the additive that holds the fibres together may be used.

As a functional embodiment, a flexible filler may furthermore be provided between the several artificial grass fibres that are held together by the additive. Said functional filler may have an additional functionality, for example, with regard to the playing characteristics of the artificial grass sports field.

The method according to the invention is further characterised by the step of adding an additive made of a decomposable material, which holds said one or more artificial grass fibres together temporarily, to the composite synthetic fibre.

According to the invention, the manufacturing process according to the prior art as described above can be simplified in that the assembling and twining steps are replaced by one (1) step, viz. composing an artificial grass fibre of one or more artificial grass fibres (being monofilaments, bands and/or tapes), using an additive made of a decomposable material. A composite artificial grass fibre according to the invention can furthermore simplify the tufting process.

The invention will now be explained in more detail with reference to the drawing, in which:

FIG. 1 shows an embodiment of an artificial lawn in which a composite artificial (i.e., synthetic) fibre 2 according to the invention can be used. The artificial lawn in the figure comprises a substrate 1, to which several composite synthetic fibres have been attached at positions indicated at 3, for example by tufting.

The synthetic fibre 2 is generally made up of several i.e., individual) artificial grass fibres 2*a*-2*b*-2*c*-etc, as a result of which a substantially identical resemblance to natural grass is created. Such artificial grass fibres 2*a*-2*c* can be produced by means of existing production techniques, such as extrusion. The individual artificial grass fibres 2*a*-2*c* thus obtained, for example by extrusion, can be twined together to form the synthetic fibre 2 and subsequently be attached to the substrate 1.

According to the invention, the synthetic fibre 2 comprises an additive made of a decomposable material, which holds the several artificial grass fibres 2*a*-2*c*-etc together temporarily.

Because of the use of said additive made of a decomposable material, the fibre(s) held together by the additive can initially, i.e. at least during the production of the composite artificial grass fibre according to the invention, be regarded as one entity, which not only simplifies the production of the artificial grass fibre and the processing thereof, but which also makes it easier to brush in the infill material. The infill material can thus be correctly provided between the joint held-together artificial grass fibres so as to thus form an adequate, functional damping under-layer between the artificial grass fibres. The artificial grass fibre is thus comparable as regards its structure to a natural lawn, in which the individual grass stalks are planted in the earth.

The use of the additive made of a decomposable material (and of the held-together composite artificial grass fibre thus obtained) furthermore makes it possible to prevent the individual artificial grass fibres from being damaged due to being overloaded during the brushing operation and/or to realise a homogeneous distribution of the infill material between the artificial grass fibres. In addition, it prevents the separate, individual artificial grass fibres from being covered with the infill material and thus losing their functionality as artificial grass sports fibres.

Figure 1:
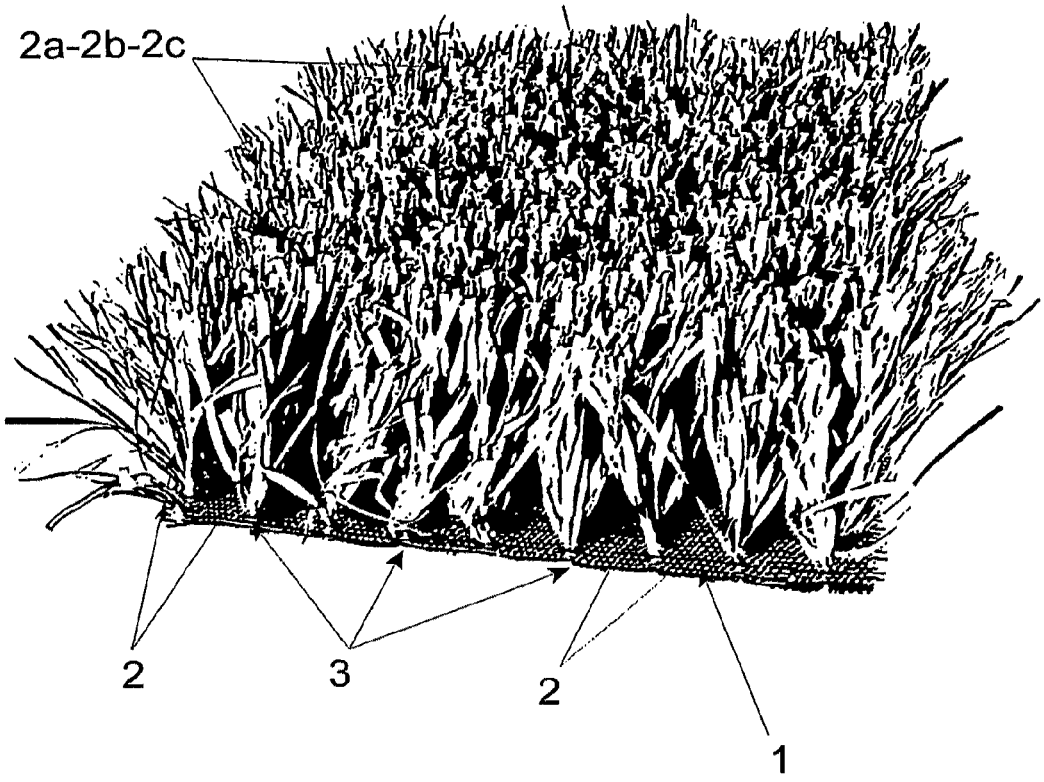
FIGS. 1 and 2 are schematic views of an embodiment of an artificial lawn.
Figure 2:
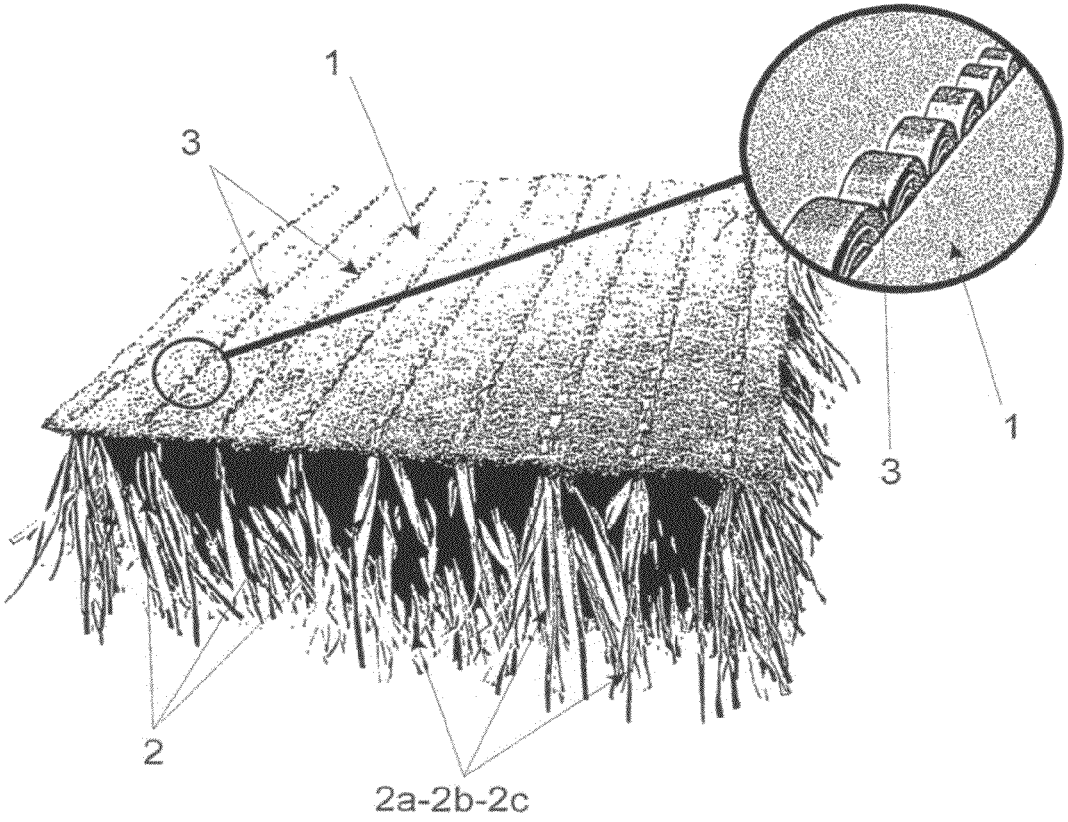
Figure 3:
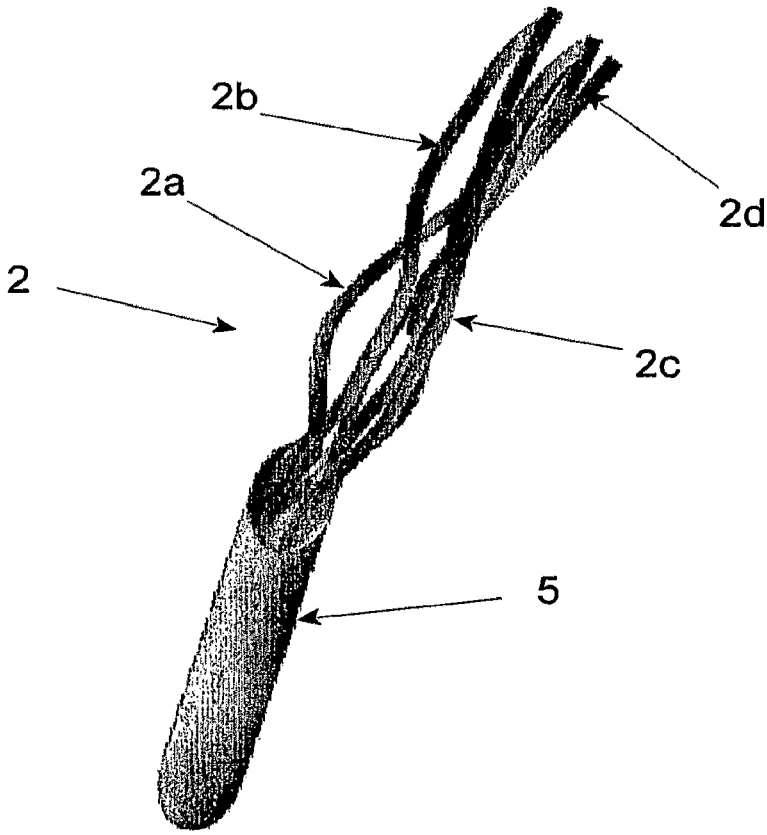
FIG. 3 is a detail view of an embodiment of a composite artificial grass fibre according to the invention.

As is disclosed in FIG. 3, the additive 5 may be provided around the individual artificial grass fibres 2*a*-2*d* of the artificial grass fibre 2 in the form of a foil envelope. Said foil envelope may thus be wrapped round the artificial grass fibre, whilst on the other hand said additive may be provided round the artificial grass fibre 2 in the form of the tubular envelope.

In fact the foil material is made of material such that it will decompose in the course of time, which time is preferably long enough to at least simplify the production process of the artificial grass fibres and the processing thereof, and preferably also to enable the installation of the artificial grass sports field and the infilling and homogeneous distribution of the synthetic infill material.

Thus it is preferable that the additive made of the decomposable material, which holds one or more artificial grass fibres to the other, decomposes under the influence of an external stimulus. This may for example be realised by adding a reagent to the artificial grass sports field, which has been installed by then, after the infill material has been incorrectly infilled and brushed in, after which the additive made of the decomposable material will decompose under the influence of said reagent and lose its holding function. In this way the individual artificial grass fibres can be separated from each other.

As a result, the playing characteristics of the artificial grass sports field are not adversely affected, because use is made of an additive according to the invention, which is made of a decomposable material.

In another embodiment, the additive made of a decomposable material may be soluble, for example in water. This latter feature makes it possible to spray the artificial sports field with water (for example rain water) after the artificial grass sports field has been installed and the infill material has been correctly brushed in so as to thus separate the individual artificial grass fibres from each other.

In another embodiment, the external stimulus for initiating the decomposition of the additive that holds the artificial grass fibres together may be ultraviolet light, for example. Thus, the decomposition of the additive that holds the artificial grass fibres together can also be controlled or initiated by sunlight.

In another embodiment, the additive that holds said one or more artificial grass fibres together temporarily can be removed during or after the production process, for example by subjecting the composite fibre to a thermal and/or a mechanical treatment. It is also possible to use a combination of the above possibilities for removing the additive.

In yet another embodiment, the decomposable additive that holds the several artificial grass fibres together may be a substance that adheres to the artificial grass fibres 2*a*-2*c*, or a flexible filler. In this latter embodiment, part of the additive may perform an additional function, viz. imparting flexibility to the composite artificial grass fibre, which has a positive effect on the playing characteristics of the artificial grass sports field.

The invention claimed is:

1. A composite artificial grass fibre for an artificial grass lawn, suitable for an artificial grass sports field, which composite artificial grass fibre comprises a fibral component comprised of at least two artificial grass fibres, and an additive component made of a decomposable or removable material, enveloping at least a portion of the fibral component, wherein said additive holds the at least two said artificial grass fibres together temporarily.

2. The composite artificial grass fibre according to claim 1, wherein said additive substantially surrounds said at least two artificial grass fibres.

3. The composite artificial grass fibre according to claim 1, wherein said additive is configured as a foil envelope.

4. The composite artificial grass fibre according to claim 1, wherein said additive is configured as a tubular envelope.

5. The composite artificial grass fibre according to claim 1, wherein said additive is around and between said artificial grass fibres.

6. The composite artificial grass fibre according to claim 5, wherein said additive is a substance that adheres to the at least two artificial grass fibres.

7. The composite artificial grass fibre according to claim 1, wherein the additive that temporarily holds said at least two artificial grass fibres together is biodegradable.

8. The composite artificial grass fibre according to claim 1, wherein the additive that temporarily holds said at least two artificial grass fibres together degrades under the influence of light.

9. The composite artificial grass fibre according to claim 1, wherein the additive that temporarily holds said at least two artificial grass fibres together degrades under the influence of a reagent.

10. The composite artificial grass fibre according to claim 1, wherein the additive that temporarily holds said at least two artificial grass fibres together is soluble.

11. The composite artificial grass fibre according to claim 1, wherein the additive that temporarily holds said at least two artificial grass fibres together can be mechanically removed.

12. The composite artificial grass fibre according to claim 1, wherein the additive that temporarily holds said at least two artificial grass fibres together can be thermally removed.

13. The composite artificial grass fibre according to claim 1, wherein the composite artificial grass fibre includes a flexible filler between the at least two artificial grass fibres that are held together by the additive.

14. An artificial grass lawn, suitable for an artificial grass sports field, said lawn having a substrate and artificial grass fibre secured thereto, wherein the artificial grass fibre comprises the composite artificial grass fibre of claim 1.

15. A method for manufacturing a composite artificial grass fibre for an artificial grass lawn, comprising the steps of:

placing at least two artificial monofilament grass fibres in partially overlapping relationship with one another; and substantially enveloping at least a portion of said overlapping artificial grass fibres with an additive comprised of a decomposable or removable material so as to temporarily hold said artificial grass fibres together and form a composite artificial grass fibre having a fibral component and an additive component.

* * * * *